US007029235B2

(12) United States Patent
Liang

(10) Patent No.: US 7,029,235 B2
(45) Date of Patent: Apr. 18, 2006

(54) COOLING SYSTEM FOR A TIP OF A TURBINE BLADE

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 139 days.

(21) Appl. No.: 10/837,328

(22) Filed: Apr. 30, 2004

(65) Prior Publication Data

US 2005/0244270 A1 Nov. 3, 2005

(51) Int. Cl.
*F01D 5/20* (2006.01)

(52) U.S. Cl. ..... 416/92; 416/97 R; 416/232

(58) Field of Classification Search ..... 416/92, 416/97 R, 232, 233, 235, 223 A; 415/115, 415/173.1

See application file for complete search history.

(56) References Cited

U.S. PATENT DOCUMENTS 2,787,441 A * 4/1957 Bartlett ..... 416/97 R
3,982,851 A 9/1976 Andersen et al.
4,010,531 A 3/1977 Andersen et al.
4,424,001 A 1/1984 North et al.
5,222,865 A 6/1993 Corsmeier
5,261,789 A 11/1993 Butts et al.
5,733,102 A 3/1998 Lee et al.
6,059,530 A 5/2000 Lee
6,086,328 A 7/2000 Lee
6,190,129 B1 2/2001 Mayer et al.
6,224,336 B1 5/2001 Kercher
6,382,913 B1 5/2002 Lee et al.
6,652,235 B1 11/2003 Keith et al.
6,672,829 B1 * 1/2004 Cherry et al. ..... 416/97 R

FOREIGN PATENT DOCUMENTS

EP 1215421 A2 6/2002

* cited by examiner

*Primary Examiner*—Edward K. Look
*Assistant Examiner*—Richard A. Edgar

(57) ABSTRACT

A turbine blade for a turbine engine having at least one secondary flow deflector proximate to a blade tip for reducing the effective flow path between the blade tip and an adjacent outer seal. The turbine blade may be a superblade having a central opening forming a hollow turbine blade. The turbine blade may include a secondary flow deflector on upstream sides of the pressure side wall and the suction side wall. The downstream sides of the pressure and suction side walls may include chamfered corners. The secondary flow deflector reduces the effective flow path between the blade tip and an outer seal in numerous ways.

20 Claims, 3 Drawing Sheets

COOLING SYSTEM FOR A TIP OF A TURBINE BLADE

FIELD OF THE INVENTION

This invention is directed generally to turbine blades, and more particularly to the cooling systems of turbine blades having a large central opening, which are referred to as hollow superblades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the tip at an opposite end of the turbine blade. The blade is ordinarily composed of a tip opposite the root section, a leading edge, and a trailing edge. One particular turbine blade design has a cavity positioned generally in central portions of the turbine blade and extending from the tip towards the root of the blade. Inner aspects of the outer wall forming the turbine blade contain an intricate maze of cooling channels forming a cooling system. The cooling channels receive air from the compressor of the turbine engine, pass the air through the blade root and cooling channels, and exhaust the cooling air from the blade. The cooling channels often include multiple flow paths that are designed to maintain all aspects of the turbine blade at a relatively uniform temperature.

The turbine blades are typically coupled to a disc of a turbine blade assembly that rotates about a rotational axis. The turbine blades extend from the disc of the turbine blade assembly such that the tips of the blades are positioned very close to an outer seal attached to the casing of the turbine engine. The outer seal does not rotate, but instead, remains stationary. As the temperature of the turbine engine increases, the turbine blades and the seal expand. Thus, a gap exists between the blade tips and the outer seal at rest and at design temperatures. Combustion gases flow between the turbine blades and between the blade tips and the seal. The gas flow between the turbine blades is referred to as primary flow, and the flow of gases outward from the lower span of the blade towards the blade tip is referred to as secondary flow. Combustion gases that flow between the blade tip and the outer seal are referred to as leakage gases because these gases are bypassing the turbine blades and not assisting the blades in rotating about the rotational axis. The greater the amount of leakage gases flowing between the blade tips and the outer seal, the more inefficient a turbine engine. Thus, a need exists for a turbine blade that effectively reduces the flow path of leakage gases between blade tips of a turbine blade assembly and an outer seal.

SUMMARY OF THE INVENTION

This invention relates to a turbine blade capable of being used in turbine engines and configured to reduce the effective flow path of leakage gases between a tip of the turbine blade and an outer seal of a turbine engine. The turbine blade may be formed from a generally elongated blade having a leading edge, a trailing edge, and a tip at a first end. The blade may also include a root coupled to the blade at an end generally opposite the first end for supporting the blade and for coupling the blade to a disc of a turbine blade assembly. The blade may also include a central opening extending from the tip through a substantial portion of the blade generally along a longitudinal axis of the blade. An outer surface of the pressure side of the blade may include a secondary flow deflector for deflecting secondary flow flowing outward from the lower blade span height towards the blade tip along an outer surface of the turbine blade upstream towards oncoming leakage flow.

The secondary flow deflector may be positioned proximate to a blade tip and, in at least one embodiment, have a generally concave shape. The secondary flow deflector directs combustion gases flowing outward along the outer surface of the turbine blade toward the oncoming combustion gases flowing towards the flow path between the blade tip and the outer seal. The secondary flow path is redirected as a result of the secondary flow deflector and thereby functions to reduce the effective size of the flow path between the blade tip and the outer seal. In at least one embodiment, an inner surface of the suction side may include a secondary flow deflector for directing outward secondary flow into the streamwise flow path of leakage gases.

The turbine blade may also include one or more exhaust holes in the tip of the turbine blade for exhausting cooling fluids through the blade tip. The cooling gases exhausted from the pressure and suction sides of the turbine blade reduce the effective leakage flow path between the blade tip and the outer seal. In addition to the exhaust holes, the turbine blade may also include one or more film cooling holes proximate to the secondary flow deflectors for exhausting cooling gases generally along an exterior surface of the secondary flow deflector. The cooling fluids flowing from the film cooling holes accelerate the secondary flow along the secondary flow deflectors and further reduce the effective flow path between the blade tip and the outer seal.

The secondary flow deflector advantageously produces a very high resistance to leakage flow between a blade tip and an outer seal. Reduction in leakage flow advantageously reduces the heat load of the blade and the corresponding blade tip cooling flow requirement. The secondary flow deflector also increases the efficiency of the turbine engine by reducing the leakage flow past the turbine blade. In addition, the secondary flow deflector advantageously reduces the heat load of the blade tip section, which increases the blade usage life. Yet another advantage associated with the secondary flow deflector is that the cooling air is exhausted at the blade tip and along the secondary flow deflector, thereby reducing the effective flow path between a blade tip and an outer seal.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
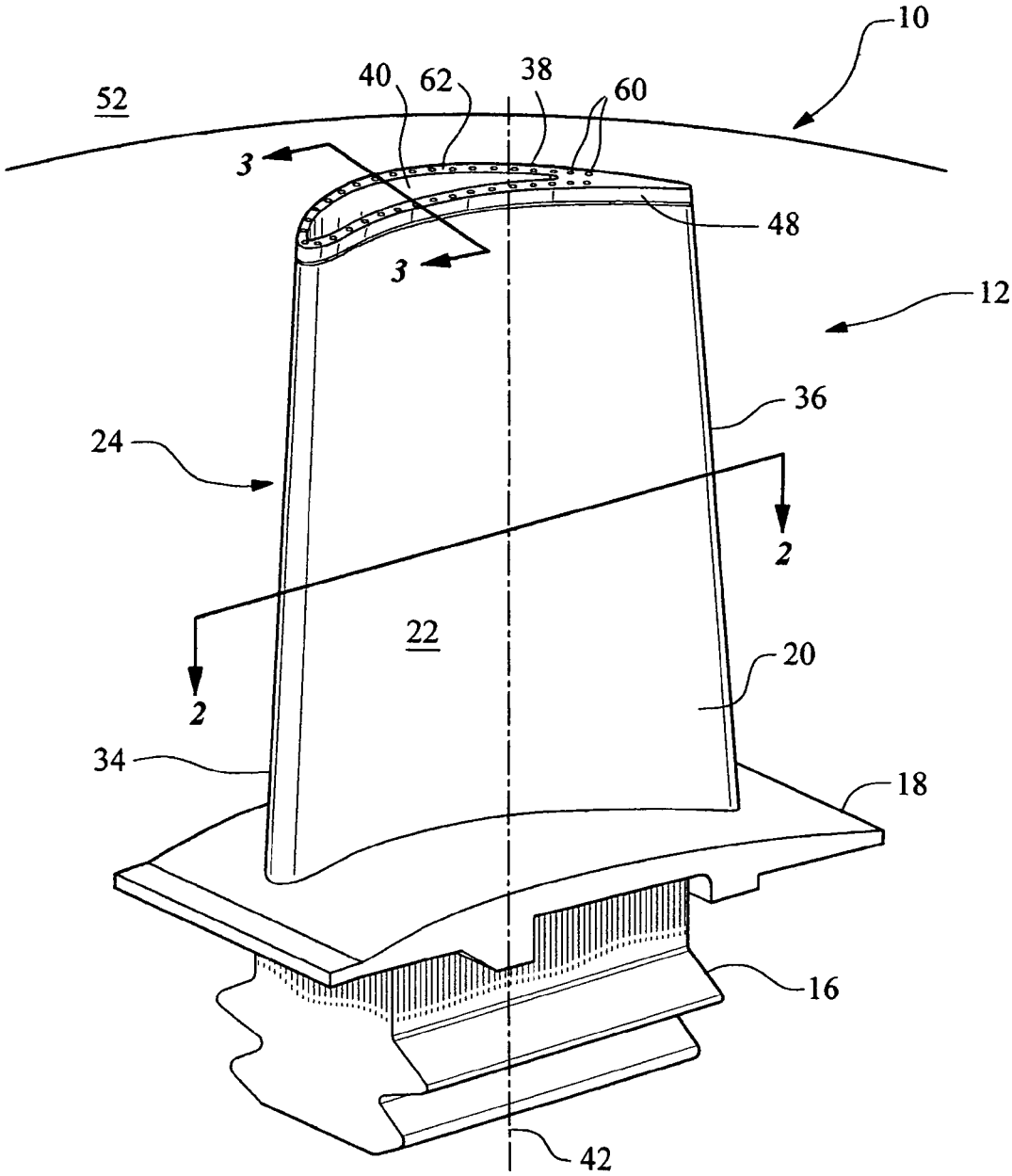
FIG. 1 is a perspective view of a turbine blade having features according to the instant invention.
Figure 2:
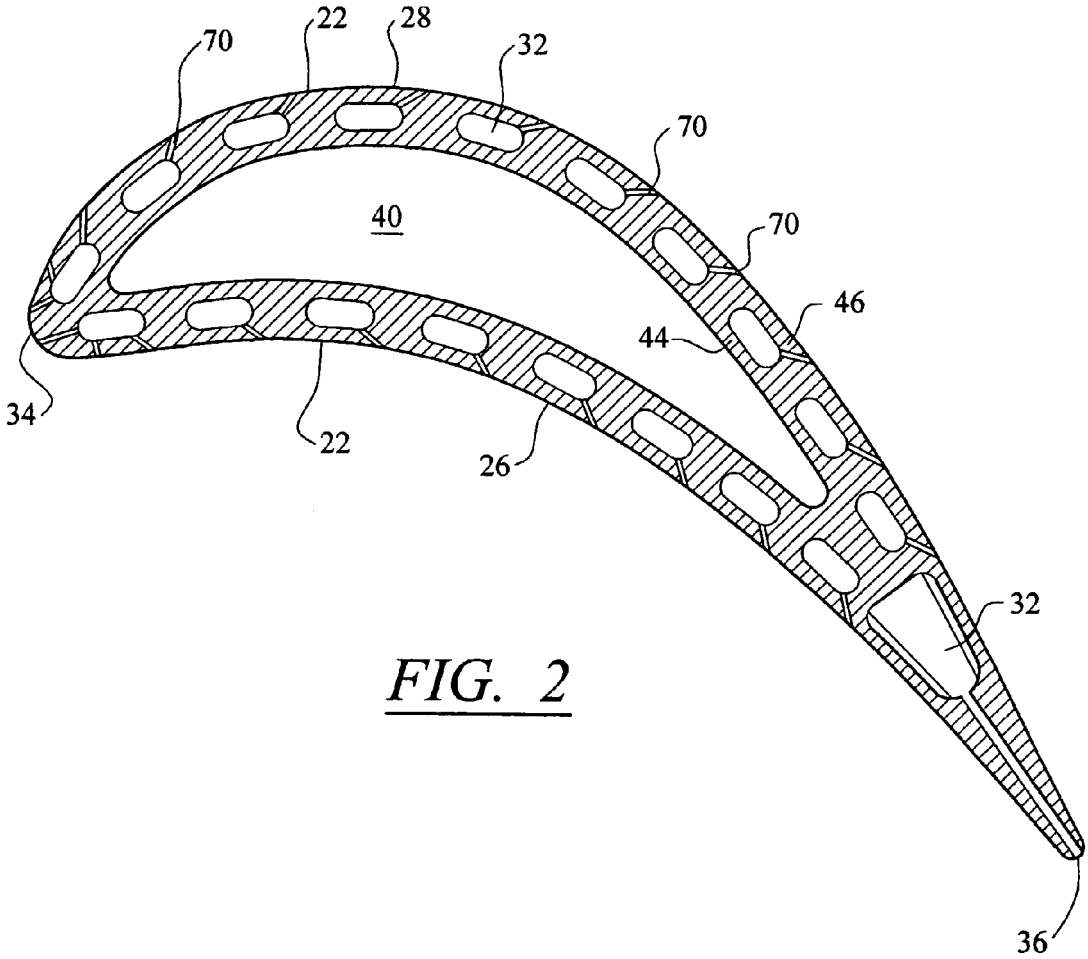
FIG. 2 is cross-sectional view of the turbine blade shown in FIG. 1 taken along section line 2—2.

As shown in FIGS. 1–5, this invention is directed to a turbine blade cooling system 10 for turbine blades 12 used in turbine engines. In particular, turbine blade cooling system 10 is directed to a cooling system located in a cavity 14, as shown in FIG. 2, positioned between two or more walls forming a housing 24 of the turbine blade 12. As shown in FIG. 1, the turbine blade 12 may be formed from a root 16 having a platform 18 and a generally elongated blade 20 coupled to the root 16 at the platform 18. Blade 20 may have an outer surface 22 adapted for use, for example, in a first stage of an axial flow turbine engine. Outer surface 22 may be formed from a housing 24 having a generally concave shaped portion forming pressure side 26 and may have a generally convex shaped portion forming suction side 28.

Figure 3:
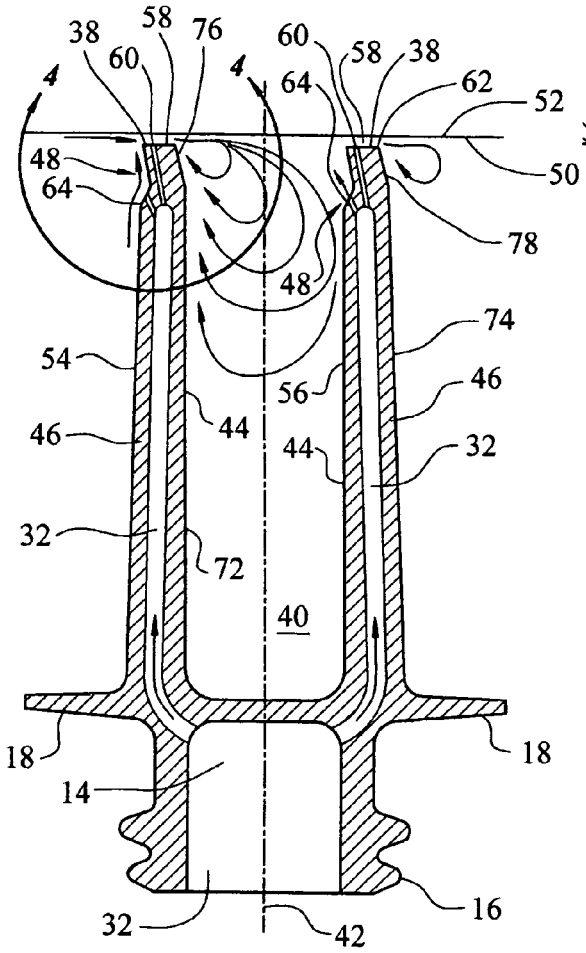
FIG. 3 is a cross-sectional view, referred to as a filleted view, of the turbine blade shown in FIG. 1 taken along section line 3—3.

The blade 20 may include one or more cooling channels 32, as shown in FIGS. 2 and 3, positioned in inner aspects of the blade 20 for directing one or more gases, which may include air received from a compressor (not shown), through the blade 20 and exhausted out of the blade 20. The cooling channels 32 are not limited to a particular configuration but may be any configuration necessary to adequately cool the blade 20. In at least one embodiment, as shown in FIG. 3, the cooling channels 32 may be formed from a plurality of channels 32 extending generally along a longitudinal axis 42 of the blade 20. The blade 20 may be formed from a leading edge 34, a trailing edge 36, and a tip 38 at an end generally opposite to the root 16. The blade 20 may also include a central opening 40 extending from the tip 38 along a longitudinal axis 42 of the blade 20 through a substantial portion of the blade 20. In at least one embodiment, the central opening 40 may extend into the blade 20 to the platform 18, as shown in FIG. 3, forming a substantially hollow blade. The embodiment shown in FIGS. 1–5 is commonly referred to as a hollow superblade.

As previously mentioned, the housing 24 may be composed of two or more walls. As shown in FIG. 3, the housing 24 may be formed from an inner wall 44 and an outer wall 46. The inner wall 44 may be configured to generally follow the contours of the outer wall 46 yet form cooling channels 32 between the inner wall 44 and the outer wall 46. The inner wall 44 may be held in place relative to the outer wall 46 using various supports.

Figure 4:
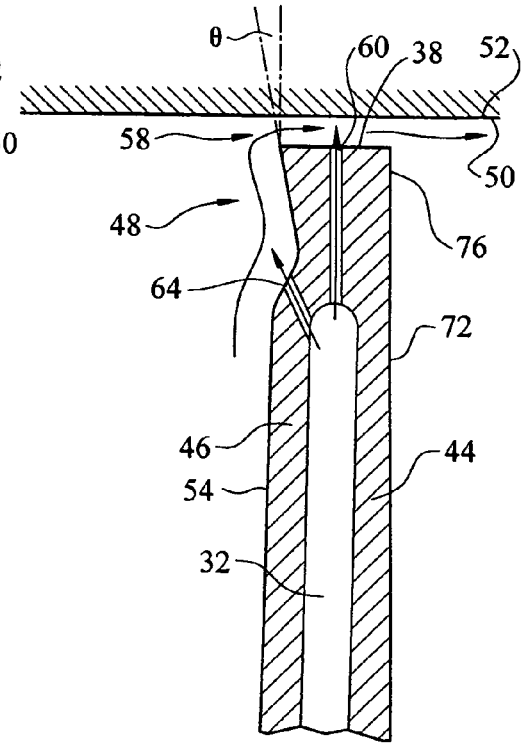
FIG. 4 is a detailed cross-sectional view of the pressure side of the turbine blade shown as detail 4 in FIG. 3.

The turbine blade cooling system 10 may also includes a secondary flow deflector 48 for reducing the effective flow path 58 between the blade tip 38 and an inner surface 50 of an outer seal 52. In at least one embodiment, as shown in FIG. 3, a secondary flow deflector 48 may be included on an outer surface 54, which is the upstream surface, of the pressure side 26 of the blade 20 proximate to the blade tip 38. The secondary flow deflector 48 may be formed from a generally concave shape or other appropriate shape. The concave shape may have an inclined surface defining an angle θ between about five degrees and about 45 degrees from a plane forming the outer surface 54, as shown in FIG. 4.

The cooling system 10 may also include a secondary flow deflector 48 on an inner surface 56, which is the upstream surface, of the suction side 28 of the blade 20 proximate to the blade tip 38. The secondary flow deflector 48 on the suction side 28 may likewise be formed from a generally concave shape or other appropriate shape for narrowing the effective width of the flow path 58 between the blade tip 38 and the outer seal 52. A portion of the secondary flow deflector 48 on the suction side 28 may have an inclined surface defining an angle between about five degrees and about 45 degrees relative to a plane forming the inner surface 56, as shown in FIG. 4, for directing gases upstream and into the leakage gas flow.

Figure 5:
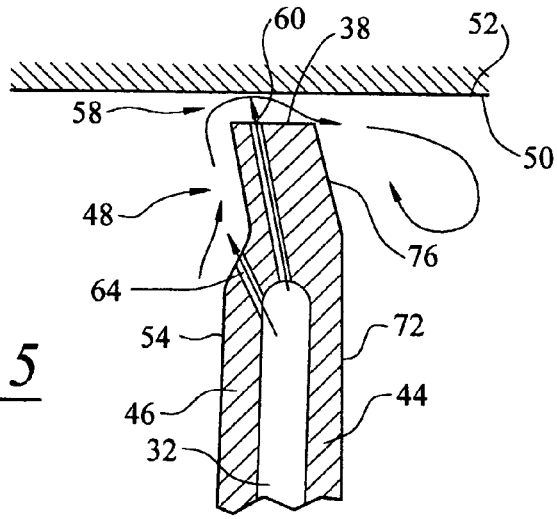
FIG. 5 is an alternative embodiment of the blade tip shown in FIG. 4.

The cooling system 10 may also include one or more exhaust holes 60 in the tip 38 of the blade 20. In at least one embodiment, the holes 60 may be positioned around a perimeter 62 of the tip 38. The holes 60 may or may not be spaced generally equidistant from each other on the tip 38. The cooling system 10 may also include one or more film cooling holes 64 positioned proximate to the secondary flow deflector 48 for exhausting cooling fluids from the cooling channels 32 and onto the secondary flow deflector 48. In at least one embodiment, as shown in FIGS. 3–5, the film cooling holes 64 may be positioned in the secondary flow deflector 48 and may protrude through a portion of the concave surface forming the secondary flow deflector 48. In at least one embodiment, the film cooling holes 64 may be aligned to exhaust cooling fluids along an outer surface of the secondary flow deflector 48 and towards the blade tip 38.

The turbine blade may also include a plurality of film cooling holes 70 positioned at various locations on the surface of the blade 20. The film cooling holes 70 provide a path between the cooling channels 32 and the surface of the blade 20 for exhausting cooling gases to cool the outer surface 22 of the turbine blade 20. The film cooling holes 70 may be positioned in any manner capable of adequately cooling the outer surface of the blade 20.

The downstream sides 72, 74 of the pressure and suction sides 26, 28, respectively, may have corners 76, 78 wherein the downstream side is generally orthogonal to the blade tip 38, as shown in FIG. 4. Alternatively, the corners 76, 78 may be chamfered, as shown in FIG. 5. The chamfered corners 76, 78 enable leakage flow to be directed upstream towards the leakage flow flowing streamwise in the flow path 58 between the blade tip 38 and the outer seal 52.

During operation of a turbine engine, the turbine blades 12 are rotated about a rotational axis and a pressure gradient is formed across the turbine blade 12, whereby a higher pressure is found proximate the pressure side 26 and a lower pressure is found proximate the suction side 28. During operation, the flow of combustor gases past the turbine blade 12 migrates from the lower span upwardly and across the blade tip 38. The flow of combustor gases outward along the outer surface 54 strikes the streamwise combustor gases flowing along the outer seal 52 and creates a counter flow. This counter flow reduces the affective flow path 58. In addition, the slanted forwarded secondary flow deflector 48 on the outer surface 54 of the pressure side 26 forces the combustor gases out of the plane of the outer surface 54 of the pressure side 26 and toward the direction from which the combustor gases are flowing. The combustor gases flowing from the secondary flow deflector 48 causes the streamwise combustor gases to be pushed toward the outer seal 52, thereby reducing the vena contractor and thus, reducing the effective flow path 58 between the blade tip 38 and the outer seal 52. The interactions of these different flow paths cooperate to reduce the leakage of combustor gases between the blade tip 38 and the outer seal 52.

In addition, the leakage flow that flows between the blade tip 38 and the outer seal 52 forms vortices behind the pressure side 26 of the blade tip 38. In particular, as the leakage flow circles through the central opening 40 and flows along the downstream side 72 of the pressure side 26 at the blade tip 38 blocking the leakage flow through the flow path 58. Thus, the vortices formed by the leakage flow also reduces the effective flow path 58 between the blade tip 38 and the outer seal 52.

The leakage flow then flows through the flow path 58 between the blade tip 38 of the suction side 28 and the outer seal 52 and forms vortices on the downstream side of the blade tip 38 on the suction side 28. The vortices cause the leakage flow to flow outward along the downstream side 74 of the suction side 28 and block the oncoming leakage flow flowing through the flow path 58 between the blade tip 38 on the suction side 28 and the outer seal 52.

In addition to the combustor gases reducing the effective flow path 58, cooling fluids are exhausted from the blade 12 to reduce the effective flow path 58 as well. The cooling fluids exhausted through the film cooling orifices 64 on the pressure side 26 accelerate that secondary flow along the outer surface 54 of the blade 20 and flow against the streamwise combustor gas flow, thereby further reducing the flow path 58 between the blade tip 38 and the outer seal 52. Cooling gases may also be exhausted through the film cooling orifices 64 on the suction side 28, which flow outwardly and push the leakage flow toward the outer seal 52. In addition, cooling gases may also be exhausted through the blade tip 38 of the pressure and suction sides 26, 28, reducing the vena contractor and the effective flow path 58.

The combination of the secondary flow deflector 48 and the exhaust and film cooling holes 60, 64 yields a high resistance for combustor gases to flow through the flow path 58 between the blade tip 38 and the outer seal 52.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade and for coupling the blade to a disc, a longitudinal axis extending from the tip to the root, at least one central opening extending from the tip through a substantial portion of the blade, wherein an outer surface of a pressure side of the blade includes a secondary flow deflector proximate to the tip;

the generally elongated blade formed from an outer wall and an inner wall with a plurality of cooling channels extending from a cooling supply cavity in the root to the tip of the blade between the outer and inner walls;

a plurality of exhaust holes in the tip that are coupled to the cooling channels for exhausting cooling fluids from the cooling channels along the longitudinal axis; and a plurality of film cooling holes in the outer surface for exhausting air onto the secondary flow deflector towards the tip.

2. The turbine blade of claim 1, wherein the secondary flow deflector is formed from a concave surface.

3. The turbine blade of claim 2, wherein a portion of the secondary flow deflector is at an angle of between about five degrees and about 45 degrees relative to an outer surface of the outer wall and positioned to direct secondary flow upstream.

4. The turbine blade of claim 1, further comprising a secondary flow deflector on an upstream side of a suction side of the turbine blade tip.

5. The turbine blade of claim 4, wherein the secondary flow deflector on the upstream side of the suction side is formed from a concave surface.

6. The turbine blade of claim 5, wherein a portion of the secondary flow deflector on the suction side is at an angle of between about five degrees and about 45 degrees relative to an outer surface of the outer wall and positioned to direct secondary flow upstream.

7. The turbine blade of claim 4, further comprising a plurality of film cooling holes in an upstream side for exhausting air onto the secondary flow deflector on the upstream side of the suction side of the turbine blade.

8. The turbine blade of claim 1, wherein the at least one central opening extends into the blade to a platform extending from the root.

9. The turbine blade of claim 1, further comprising a plurality of film cooling holes exhausting cooling air from the plurality of cooling channels through a portion of the outer wall forming the pressure side.

10. The turbine blade of claim 9, further comprising a plurality of film cooling holes exhausting cooling air from the plurality of cooling channels through a portion of the outer wall forming the suction side.

11. The turbine blade of claim 1, further comprising a chamfered corner on a downstream corner of the pressure side of the turbine blade.

12. The turbine blade of claim 11, further comprising a chamfered corner on a downstream corner of the suction side of the turbine blade.

13. A turbine blade, comprising:

a generally elongated blade having a leading edge, a trailing edge, and a tip at a first end, a root coupled to the blade at an end generally opposite the first end for supporting the blade and for coupling the blade to a disc, a longitudinal axis extending from the tip to the root, at least one central opening extending from the tip through a substantial portion of the blade, wherein an outer surface of a pressure side of the blade includes a secondary flow deflector proximate the tip and an interior surface of a suction side of the blade includes a secondary flow deflector proximate to the tip;

the generally elongated blade formed from an outer wall and an inner wall with a plurality of cooling channels extending from a cooling supply cavity in the root to the tip of the blade between the outer and inner walls;

a plurality of exhaust holes in the tip that are coupled to the cooling channels for exhausting cooling fluids from the cooling channels along the longitudinal axis; and a plurality of film cooling holes in the outer surface exhausting air onto the secondary flow deflectors towards the tips of the blade.

14. The turbine blade of claim 13, wherein the secondary flow deflectors are formed from concave surfaces.

15. The turbine blade of claim 14, wherein portions of the secondary flow detectors are at angles of between about five degrees and about 45 degrees relative to upstream sides of the pressure side and the suction side.

16. The turbine blade of claim 13, wherein the at least one central opening extends into the blade to a platform extending from the root.

17. The turbine blade of claim 13, further comprising a plurality of film cooling holes exhausting cooling air from the plurality of cooling channels through a portion of the outer wall forming the pressure side.

18. The turbine blade of claim 17, further comprising a plurality of film cooling holes exhausting cooling air from the plurality of cooling channels through a portion of the outer wall forming the suction side.

19. The turbine blade of claim 13, further comprising a chamfered corner on a downstream corner of the pressure side of the turbine blade.

20. The turbine blade of claim 19, further comprising a chamfered corner on a downstream corner of the suction side of the turbine blade.

* * * * *